US008432338B2

(12) United States Patent
Ono

(10) Patent No.: US 8,432,338 B2
(45) Date of Patent: Apr. 30, 2013

(54) IMAGE DISPLAY DEVICE HAVING A PLURALITY OF PIXEL CIRCUITS USING CURRENT-DRIVEN TYPE LIGHT-EMITTING ELEMENTS

(75) Inventor: Shinya Ono, Osaka (JP)

(73) Assignee: Panasonic Corporation, Osaka (JP)

( * ) Notice: Subject to any disclaimer, the term of this patent is extended or adjusted under 35 U.S.C. 154(b) by 840 days.

(21) Appl. No.: 12/439,542

(22) PCT Filed: Jun. 13, 2008

(86) PCT No.: PCT/JP2008/001522

§ 371 (c)(1),
(2), (4) Date: Mar. 1, 2009

(87) PCT Pub. No.: WO2008/152817

PCT Pub. Date: Dec. 18, 2008

(65) Prior Publication Data

US 2010/0007645 A1 Jan. 14, 2010

(30) Foreign Application Priority Data

Jun. 15, 2007 (JP) ..... 2007-158251
Jun. 15, 2007 (JP) ..... 2007-158252

(51) Int. Cl.
*G09G 3/32* (2006.01)

(52) U.S. Cl.
USPC ..... 345/82

(58) Field of Classification Search ..... 345/36, 345/39, 45, 76–83
See application file for complete search history.

(56) References Cited

U.S. PATENT DOCUMENTS 7,847,762 B2 12/2010 Iida et al.
7,903,057 B2 3/2011 Uchino et al.
2004/0108979 A1 6/2004 Seki
2006/0139259 A1* 6/2006 Choi et al. ..... 345/76
2006/0187153 A1* 8/2006 Nathan et al. ..... 345/76
2007/0273621 A1* 11/2007 Yamashita et al. ..... 345/76
2008/0030437 A1 2/2008 Iida et al.
2008/0088546 A1 4/2008 Takasugi et al.
2009/0091562 A1 4/2009 Uchino et al.

FOREIGN PATENT DOCUMENTS

JP 2002-514320 A 5/2002
JP 2003-228324 A 8/2003
JP 2003-228324 A 8/2003
JP 2004-151194 A 5/2004

(Continued)

OTHER PUBLICATIONS

International Search Report for International Search Report for International Application No. PCT/JP2008/001522, Jul. 15, 2008, Panasonic Corporation.

*Primary Examiner* — Chanh Nguyen
*Assistant Examiner* — Sanghyuk Park
(74) *Attorney, Agent, or Firm* — RatnerPrestia

(57) ABSTRACT

An image display device having a plurality of pixel circuits arranged in matrix, each comprising current-driven type light-emitting element, driver transistor for supplying a current to current-driven type light-emitting element, holding capacitor for holding a voltage that determines an amount of the current supplied from driver transistor, and writing switch for writing a voltage corresponding to an image signal into holding capacitor. The transistor formed in each pixel circuit is N-channel transistor. Each pixel circuit further comprises detection trigger line and detection trigger capacitor for supplying a voltage to change a source voltage of driver transistor. One terminal of detection trigger capacitor is connected to a source of driver transistor and the other terminal of detection trigger capacitor is connected to detection trigger line.

6 Claims, 18 Drawing Sheets

FOREIGN PATENT DOCUMENTS

| | | | |
|---|---|---|---|
| JP | 2004-246204 | A | 9/2004 |
| JP | 2004-246204 | A | 9/2004 |
| JP | 2004-280059 | A | 10/2004 |
| JP | 2004-295131 | A | 10/2004 |
| JP | 2006-215275 | A | 8/2006 |
| JP | 2007-133282 | A | 5/2007 |
| JP | 2008-026468 | A | 2/2008 |
| JP | 2008-033194 | A | 2/2008 |
| JP | 2008-170857 | A | 7/2008 |
| JP | 2008-310033 | A | 12/2008 |
| WO | WO 98/48403 | | 10/1998 |
| WO | WO 2006/090560 | A1 | 8/2006 |
| WO | WO2006/090560 | A1 | 8/2006 |

* cited by examiner

IMAGE DISPLAY DEVICE HAVING A PLURALITY OF PIXEL CIRCUITS USING CURRENT-DRIVEN TYPE LIGHT-EMITTING ELEMENTS

TECHNICAL FIELD

The present invention relates to an active-matrix type image display device using current-driven type light-emitting elements.

BACKGROUND ART

Organic electroluminescence ("EL") display devices of a type comprising a matrix of a large number of self-luminous organic EL elements hold great promise as the next generation of image display devices since they require no backlighting nor do they restrict viewing angles.

The organic EL elements are light-emitting elements of a current-driven type, of which brightness can be controlled by an amount of electric current flowed through them. There are simple matrix type and active matrix type as the methods of driving the organic EL elements. The former has a drawback that it is difficult to produce a large-scale and high-definition display although it only needs simple pixel circuits. It is for this reason that the efforts are being made actively in recent years for development of organic EL display devices of the active matrix type, which is composed of a matrix of pixel circuits having organic EL elements, each provided with a driver transistor for driving the current-driven type light-emitting element.

The driver transistor and the peripheral circuit are formed generally of thin film transistors. There are thin film transistors of a type made of polysilicon and another type made of amorphous silicon. The amorphous silicon thin-film transistors are suitable for large-scale organic EL display devices since they feature a high uniformity in mobility, easy to fit for upsizing, and inexpensive, although they have some weaknesses such as poor mobility and large changes in the threshold voltage with time. There have been some studies conducted for measures to overcome the weakness, or the changes in the threshold voltage with time, of the amorphous silicon thin-film transistors by improvements of the pixel circuits. Patent document 1, for instance, discloses an organic EL display device having pixel circuits capable of displaying a stable image by keeping an amount of the currents supplied to the light-emitting elements free from influence of the threshold voltage of thin film transistors even when the threshold voltage changes.

According to the pixel circuits disclosed in the patent document 1, however, it is necessary to pulse-driving a common line in connection with cathodes of the plurality of organic EL elements. Since the plurality of organic EL elements has a large electrostatic capacitive component, the common line momentarily draws a large current when it is pulse-driven. It thus has a problem that the circuit for driving the common line bears a large load, and therefore not suitable for a large-scale image display device.

Furthermore, the pixel circuit described in the patent document 1 is a drive circuit designed on a condition that it uses enhancement-type transistors with a positive threshold voltage as the driver transistors. Therefore, it does not allow use of depletion-type transistors with a negative threshold voltage as the driver transistors. It is desirable, however, that the pixel circuits are operable with any of the enhancement-type transistors and the depletion-type transistors in order to increase the flexibility of manufacturing the thin-film transistors and to deal with the changes in the threshold voltage with time.

In addition, it is necessary to compose the image circuits only with N-channel transistors since the N-channel transistors are the only type that is now in practical use as amorphous-silicon thin-film transistors for large-scale image display devices. Moreover, it is also preferable that the circuits have a structure allowing connections of anodes of organic EL elements to sources of the driver transistors and cathodes of the organic EL elements to a common electrode so as to ease the manufacturing of the organic EL elements.

[Patent Document 1] Japanese Patent Unexamined Publication, No. 2004-295131

SUMMARY OF THE INVENTION

The present invention covers an image display device provided with a plurality of pixel circuits arranged in a matrix form, each of the pixel circuits comprising a current-driven type light-emitting element, a driver transistor for supplying an electric current to the current-driven type light-emitting element, a holding capacitor for holding a voltage that determines an amount of the electric current supplied from the driver transistor and a writing switch for writing a voltage corresponding to an image signal into the holding capacitor. The transistor formed in each of the pixel circuits is an N-channel transistor, and the each pixel circuit further comprises a detection trigger line and a detection trigger capacitor for supplying a voltage to change a source voltage of the driver transistor. One terminal of the detection trigger capacitor is connected to a source of the driver transistor, and the other terminal of the detection trigger capacitor is connected to the detection trigger line. It becomes possible according to the above structure to provide the image display device comprising the pixel circuits formed of N-channel transistors only and having the current-driven type light-emitting elements connected with the sources of the driver transistors.

Each pixel circuit in the image display device of the present invention may be so configured that the current-driven type light-emitting element is connected between the source of the driver transistor and a low-voltage side power line, and provided additionally with an enable switch connected between the drain of the driver transistor and a high-voltage side power line. In this structure, variations in voltage during the writing operation can be controlled by using the enable switch, so as to regulate positively the voltage of the holding capacitor.

In addition, each pixel circuit in the image display device of the present invention may further comprise a separation switch connected to the detection trigger capacitor in such a configuration that one terminal of the detection trigger capacitor is connected with the source of the driver transistor through this separation switch. Since this structure allows no element in series connection with the organic EL element, other than the driver transistor, it can help regulate the voltage of the holding capacitor positively while also reducing a loss of the power.

Moreover, each pixel circuit in the image display device of the present invention has a structure, in which the current-driven type light-emitting element is connected between the source of the driver transistor and the low-voltage side power line, and the drain of the driver transistor is connected to the high-voltage side power line. Since this structure has no element in series connection with the organic EL element, other than the driver transistor, it can provide the image display device of a high efficiency with a low loss of the power.

Furthermore, each pixel circuit in the image display device of the present invention may further include a reference switch, wherein one terminal of the reference switch is connected to the gate of the driver transistor, and the other terminal of the reference switch is connected to a reference voltage line for applying a reference voltage. This structure can help set a longer duration of light emitting period.

REFERENCE MARKS IN THE DRAWINGS

Figure 1:
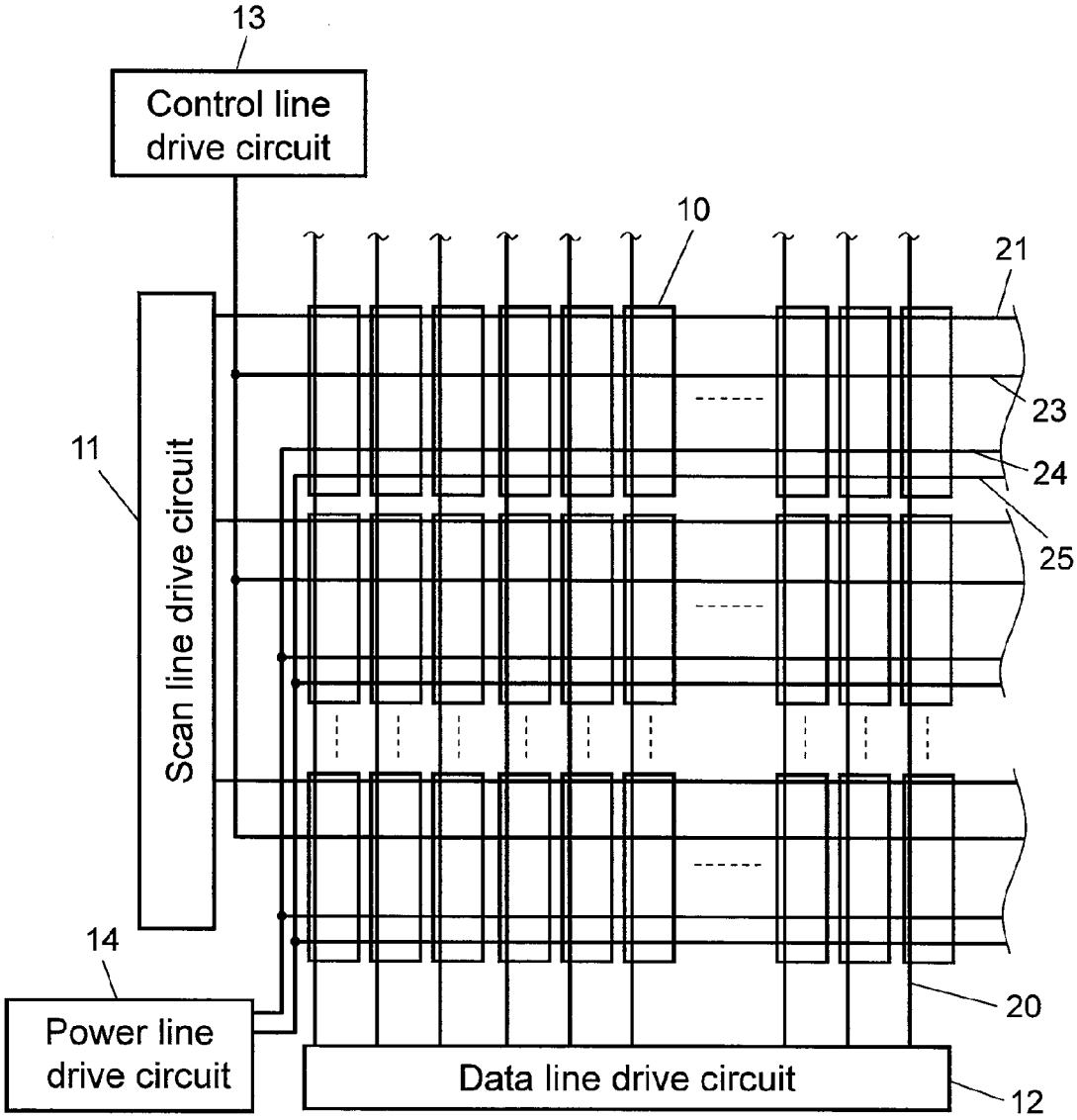
FIG. 1 is a schematic diagram showing a structure of an organic EL display according to a first exemplary embodiment of the present invention.

10, 30 and 40 Pixel circuit
11 and 41 Scan line drive circuit
12 Data line drive circuit
13 and 33 Control line drive circuit
14 and 44 Power line drive circuit
20 Data line
21 and 51 Scan line
22 and 34 Enable line
23, 35 and 54 Detection trigger line
24 High-voltage side power line
25 Low-voltage side power line
D1 Organic EL element
C1 Holding capacitor
C2 Detection trigger capacitor
Q1 Driver transistor
Q2, Q3, Q4 and Q5 Transistor
SW2, SW3, SW4 and SW5 Switch

DETAILED DESCRIPTION OF PREFERRED EMBODIMENTS

Referring to the accompanying drawings, description is provided hereinafter of image display devices of active matrix type according to exemplary embodiments of the present invention. Although the image display devices described herein represent typical organic EL display devices of the active matrix type that use thin film transistors to illuminate organic EL elements, the present invention is generally applicable to any image display device of the active matrix type that uses light-emitting elements, brightness of which can be controlled by an amount of electric current flowed through them.

First Exemplary Embodiment

FIG. 1 is a schematic diagram showing a structure of an organic EL display device according to this exemplary embodiment of the invention.

The organic EL display device in this exemplary embodiment comprises a plurality of pixel circuits 10 arranged in a matrix form, scan line drive circuit 11, data line drive circuit 12, control line drive circuit 13 and power line drive circuit 14. Scan line drive circuit 11 supplies scan signal Scn to pixel circuits 10. Data line drive circuit 12 supplies data signal $D_{ata}$ corresponding to an image signal to pixel circuits 10. Control line drive circuit 13 supplies detection trigger signal Trg to pixel circuits 10. Power line drive circuit 14 supplies an electric power to pixel circuits 10. Description is provided in this exemplary embodiment of an example, in which pixel circuits 10 are arranged in a form of n-row by m-column matrix.

Scan line drive circuit 11 supplies scan signal Scn independently to each of scan lines 21 connecting across pixel circuits 10 arranged in the row direction in FIG. 1. On the other hand, data line drive circuit 12 supplies data signal $D_{ata}$ independently to each of data lines 20 connecting across pixel circuits 10 arranged to the column direction in FIG. 1. In this exemplary embodiment, a number of scan lines 21 and a number of data lines 20 are n and m respectively.

Control line drive circuit 13 supplies detection trigger signal Trg individually to detection trigger lines 23 connecting throughout all pixel circuits 10. Power line drive circuit 14 supplies an electric power between high-voltage side power lines 24 and low-voltage side power lines 25 connecting throughout all pixel circuits 10.

Figure 2:
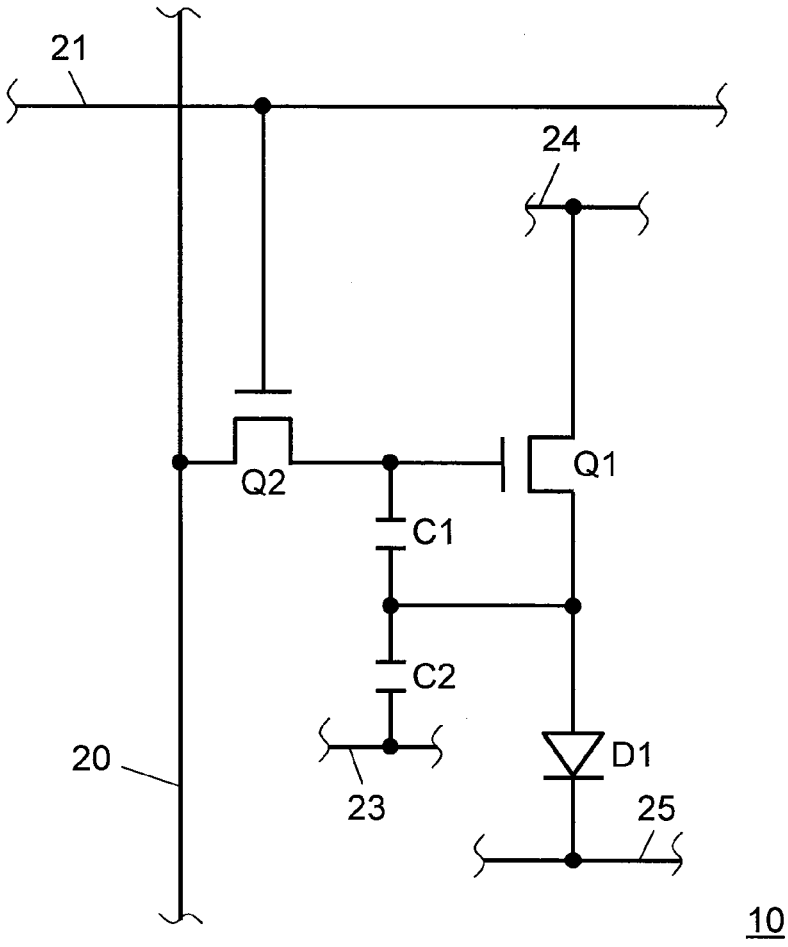
FIG. 2 is a circuit diagram of a pixel circuit according to the first exemplary embodiment of the present invention.

FIG. 2 is a circuit diagram of pixel circuit 10 according to this exemplary embodiment.

Pixel circuit 10 comprises organic EL element D1, or a current-driven type light-emitting element, driver transistor Q1, holding capacitor C1 and transistor Q2. Driver transistor Q1 supplies a flow of electric current to organic EL element D1 to cause it to emit light. Holding capacitor C1 holds a voltage that determines an amount of the electric current supplied to driver transistor Q1. Transistor Q2 functions as a writing switch for writing a voltage corresponding to an image signal into holding capacitor C1.

Pixel circuit 10 further includes detection trigger lines 23 and detection trigger capacitor C2 for supplying a voltage, or detection trigger signal Trg, which decreases source voltage Vs of driver transistor Q1, in order to detect threshold voltage Vth of driver transistor Q1.

Both driver transistor Q1 and transistor Q2 that compose pixel circuit 10 shown here are N-channel thin film transistors. Although the driver transistor Q1 and transistor Q2 are described as being enhancement-type transistors, they may as well be depletion-type transistors.

Organic EL element D1 is connected between the source of driver transistor Q1 and low-voltage side power line 25, and the drain of driver transistor Q1 is connected to high-voltage side power line 24. The source of driver transistor Q1 is connected to the anode of organic EL element D1, and the cathode of organic EL element D1 is connected to low-voltage side power line 25. In this embodiment here, the voltage supplied to high-voltage side power line 24 is 20 volts, and the voltage supplied to low-voltage side power line 25 is 0 volt, for example.

Holding capacitor C1 is connected between the gate and the source of driver transistor Q1. Either the drain or the source of transistor Q2 is connected to the gate of driver transistor Q1 whereas the source or the drain of transistor Q2 is connected to data line 20, and the gate of transistor Q2 is connected to scan lines 21. One terminal of detection trigger capacitor C2 is connected with the source of driver transistor Q1, and the other terminal of detection trigger capacitor C2 is connected with detection trigger line 23.

Figure 3:
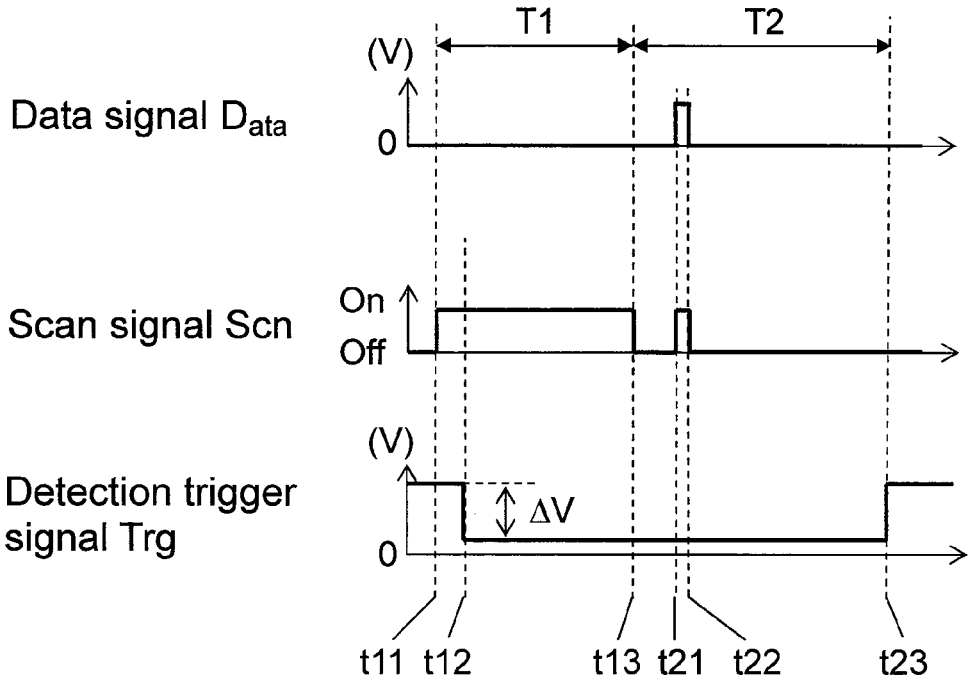
FIG. 3 is a timing chart showing operation of the pixel circuit according to the first exemplary embodiment of the present invention.

Description is provided next of how pixel circuit 10 operates in this exemplary embodiment. FIG. 3 is a timing chart showing the operation of pixel circuit 10 according to this exemplary embodiment of the invention. In this exemplary embodiment, each of organic EL elements D1 is driven in two divided periods, i.e., threshold detecting period T1 and writing & light-emitting period T2, for convenience' sake. In the threshold detecting period T1, threshold voltage Vth of driver transistor Q1 is detected. In the writing & light-emitting period T2, a voltage corresponding to the image signal is written into holding capacitor C1, and organic EL element D1 is driven to emit light according to the voltage written in holding capacitor C1. Description is now provided in further detail of how pixel circuit 10 operates in each of the above periods.

(Threshold Detecting Period T1)

Figure 4:
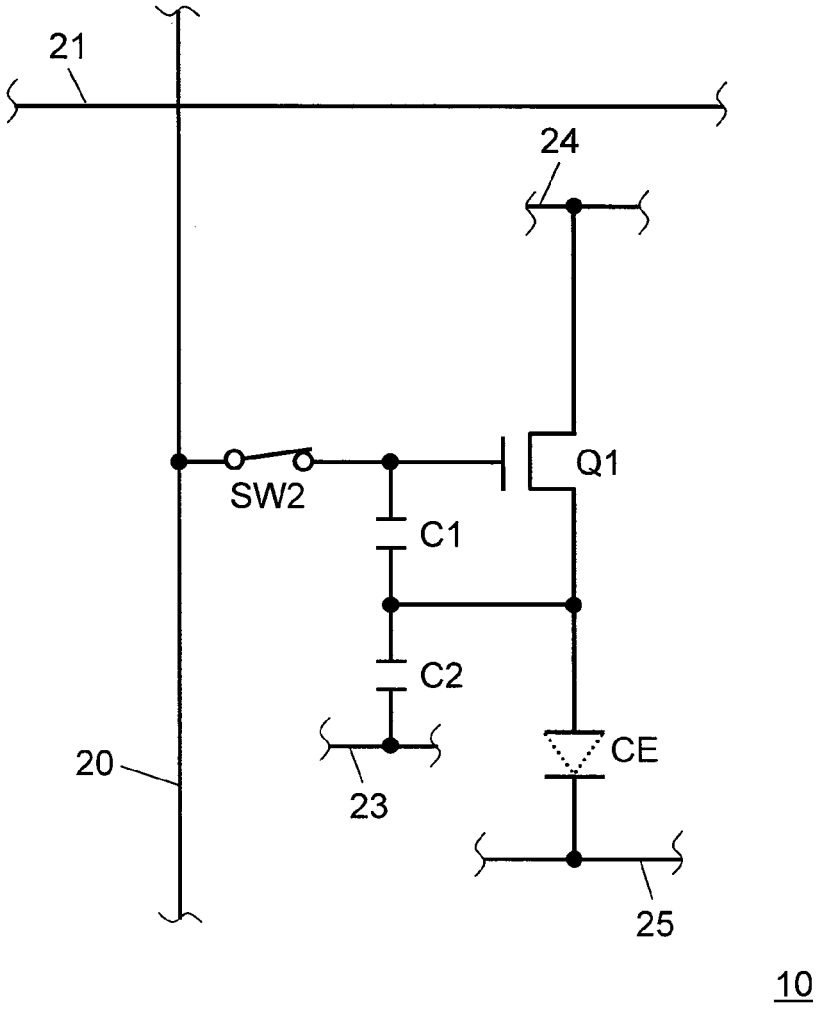
FIG. 4 is an explanatory diagram showing operation of the image display device during a threshold detecting period according to the first exemplary embodiment of the present invention.

FIG. 4 is an explanatory diagram showing operation of the image display device during the threshold detecting period T1 according to this exemplary embodiment. In FIG. 4, transistor Q2 of FIG. 2 is replaced by switch SW2, and organic EL element D1 is replaced by capacitor CE for the purpose of easing the explanation.

At the initial time t11 of threshold detecting period T1, scan signal Scn rises to a high level, and switch SW2 turns into an on-state. At this moment, a voltage of 0-volt potential is applied as data signal $D_{ata}$ on the gate of driver transistor Q1, and driver transistor Q1 therefore remains in an off-state. There is thus no electric current flowing through organic EL element D1, and organic EL element D1 functions as capacitor CE. In addition, source voltage Vs of driver transistor Q1 becomes an off-state voltage VEoff of organic EL element D1.

Next, detection trigger signal Trg is decreased by voltage ΔV at time t12. This causes source voltage Vs of driver transistor Q1 to decrease by an amount obtained by capacitively dividing the voltage ΔV with a capacitance of detection trigger capacitor C2 and a combined capacitance of holding capacitor C1 and capacitor CE. In other words, source voltage Vs of driver transistor Q1 becomes a value given by $$Vs = VEoff - \frac{C2}{C1 + C2 + CE} \cdot \Delta V. \quad \text{(Equation 1)}$$

In an example where off-state voltage VEoff of organic EL element D1 is 2 volts, capacitance ratios of the capacitors C1, C2 and CE are 1:1:2, and voltage ΔV is 30 volts, then the source voltage Vs of driver transistor Q1 becomes −5.5 volts.

As a result, driver transistor Q1 turns into an on-state since voltage Vgs between the gate and the source of driver transistor Q1 becomes equal to or greater than threshold voltage Vth. This causes holding capacitor C1 and capacitor CE to discharge their electric charges, and source voltage Vs starts rising due to electricity charged in detection trigger capacitor C2. When voltage Vgs between the gate and the source of driver transistor Q1 becomes equal to threshold voltage Vth, driver transistor Q1 turns into an off-state. Source voltage Vs of driver transistor Q1 thus becomes a value given by $$Vs = -Vth. \quad \text{(Equation 2)}$$

This means that voltage VC1 of holding capacitor C1 becomes equal to threshold voltage Vth. Accordingly, holding capacitor C1, detection trigger capacitor C2 and capacitor CE hold voltage Vth.

Assume here that driver transistor Q1 is made of a depletion-type transistor. When threshold voltage Vth has a negative value, it is known that the threshold value of the depletion-type transistor can be detected if voltage −Vth is below the electric potential of the high-voltage side power line, and their values satisfy:

$$-Vth < VEoff. \quad \text{(Equation 3)}$$

If off-state voltage VEoff of organic EL element D1 is 2 volts and the electric potential of the high-voltage side power line is 20 volts, for example, threshold voltage Vth of −2 volts can be detected. In the case of detecting a threshold voltage lower than the above, it only needs to decrease the voltage of data line 20 during threshold detecting period T1.

Following the above, scan signal Scn is changed to a low level to turn switch SW2 into an off-state at time t13 immediately before the end of threshold detecting period T1.

(Writing & Light-Emitting Period T2)

In writing & light-emitting period T2, scan signal Scn of corresponding pixel circuit 10 rises to a high level, and switch SW2 comes into an on-state at time t21. At this moment, voltage $V_{data}$ corresponding to the image signal supplied to data line 20 is applied to the gate of driver transistor Q1. This causes voltage VC1 of holding capacitor C1 to increase by an amount obtained by capacitively dividing a value of voltage $V_{data}$ with a capacitance of holding capacitor C1 and a combined capacitance of detection trigger capacitor C2 and capacitor CE, as given by $$VC1 = Vth + \frac{C2 + CE}{C1 + C2 + CE} \cdot Vdata. \quad \text{(Equation 4)}$$

The writing operation into holding capacitor C1 is thus carried out in the above manner.

When the writing operation in pixel circuit 10 is completed at time t22, the corresponding scan signal Scn is switched back to the low level to turn switch SW2 into the off-state.

After the above, driver transistor Q1 lets an electric current corresponding to voltage $V_{data}$ to flow therethrough to have organic EL element D1 emit light of a brightness corresponding to the image signal since voltage VC1 of holding capacitor C1, i.e., voltage Vgs between the gate and the source of driver transistor Q1, is set to the voltage equal to or greater than the threshold voltage Vth.

Following the writing operation described above, detection trigger signal Trg is switched back to the original voltage at time t23 before the end of writing & light-emitting period T2.

When organic EL element D1 is lit in the above operation, an electric current Ipxl that flows through organic EL element D1 has an amount given by $$Ipxl = \frac{\beta}{2} \cdot (Vgs - Vth)^2 = \frac{\beta}{2} \cdot \left(\frac{C2 + CE}{C1 + C2 + CE} \cdot Vdata\right)^2 \quad \text{(Equation 5)}$$

where β is a coefficient determined based on the mobility μ, capacitance Cox of a gate insulation film, channel length L and channel width W of driver transistor Q1, and it is given by $$\beta = \mu \cdot Cox \cdot \frac{W}{L}. \quad \text{(Equation 6)}$$

As shown, the electric current Ipxl that flows through organic EL element D1 does not include a factor of threshold voltage Vth. The electric current Ipxl flowing through organic EL element D1 can thus make it emit light of the brightness corresponding to the image signal without being influenced by threshold voltage Vth of driver transistor Q1 even when it changes with the lapse of time.

As described above, it becomes possible to use only N-channel transistors according to the present exemplary embodiment to form pixel circuits 10, each having organic EL element D1 connected to the source of respective driver transistor Q1 and cathode of organic EL element D1 connected to the common low-voltage side power line. The pixel circuits in this exemplary embodiment are therefore very suitable for composing large-scale display devices with amorphous-silicon thin-film transistors. The structure is also preferable even when pixel circuits are composed by using polysilicon thin film transistors. What is disclosed in this exemplary embodiment is a technique of using the detection trigger signal to avoid the influence of changes in the threshold voltage Vth. The invented technique can hence be materialized easily with a simple control as compared to the other techniques such as the one that requires to change the power supply voltage, in addition to an advantage that it does not receive the influence of voltage fluctuations since the control can be carried out with a small current like the detection trigger signal.

Second Exemplary Embodiment

Figure 5:
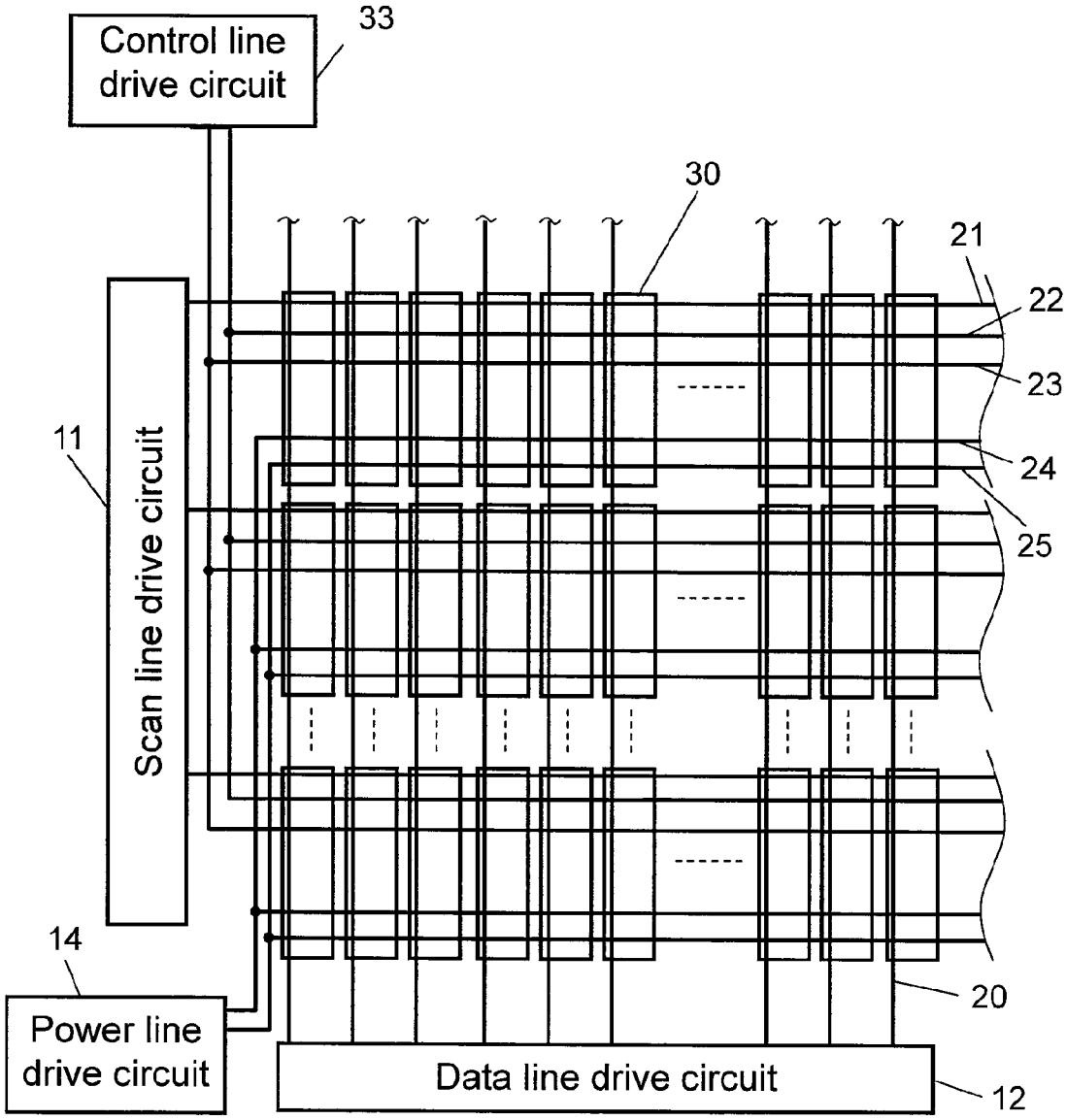
FIG. 5 is a schematic diagram showing a structure of an organic EL display according to a second exemplary embodiment of the present invention.
Figure 6:
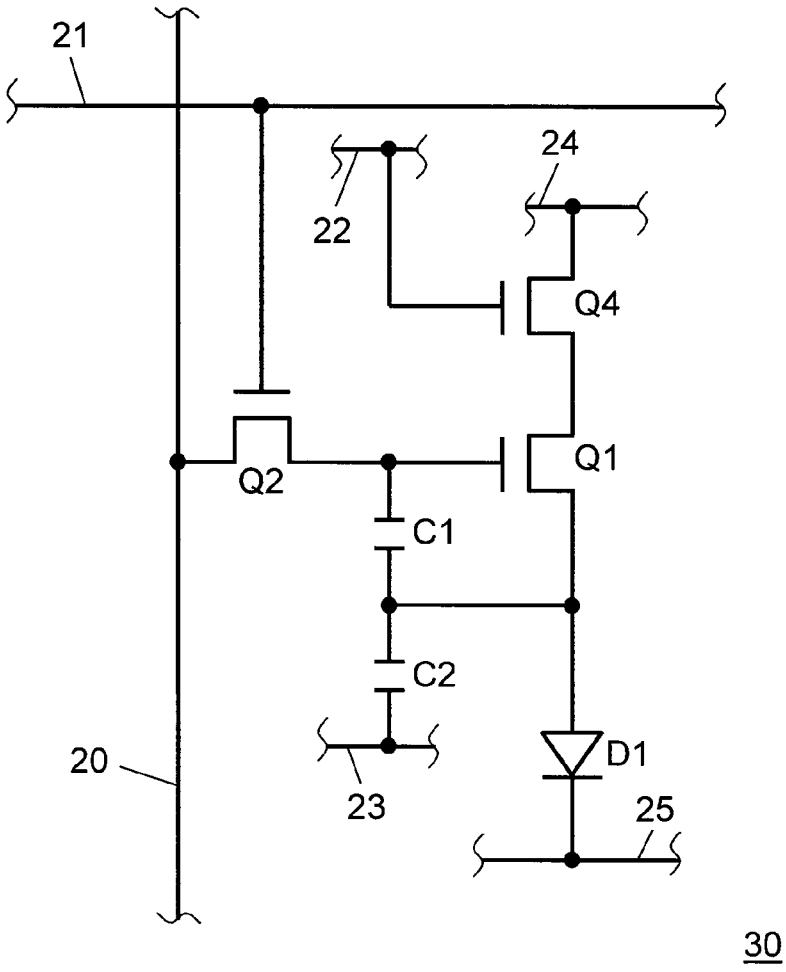
FIG. 6 is a circuit diagram of a pixel circuit according to the second exemplary embodiment of the present invention.

FIG. 5 is a schematic diagram showing a structure of organic EL display device according to this exemplary embodiment of the invention, and FIG. 6 is a circuit diagram of pixel circuit 30 of this exemplary embodiment. In comparison with the first exemplary embodiment, the organic EL display device of this exemplary embodiment is provided with control line drive circuit 33 for supplying enable signal Enbl in addition to detection trigger signal Trg to the individual pixel circuits 30. In this exemplary embodiment, each of pixel circuits 30 further comprises transistor Q4 having a function of enable switch for breaking a current path to organic EL element D1 during the writing period for writing a voltage into holding capacitor C1. Here, like reference marks are used to designate like components as those of the first exemplary embodiment, and their details are skipped. Description is provided in this exemplary embodiment also of an example that pixel circuits 30 are arranged in a form of n-row by m-column matrix.

Control line drive circuit 33 supplies enable signal Enbl and detection trigger signal Trg respectively to enable lines 22 and detection trigger lines 23 connecting throughout all pixel circuits 30 as shown in FIG. 5.

Each pixel circuit 30 in this exemplary embodiment has transistor Q4, or the enable switch, connected between the drain of driver transistor Q1 and high-voltage side power line 24, as shown in FIG. 6. The gate of transistor Q4 is connected to enable line 22. In other words, the drain of transistor Q4 is connected to high-voltage side power line 24, and the source of transistor Q4 is connected to the drain of driver transistor Q1. The source of driver transistor Q1 is connected to the anode of organic EL element D1. The cathode of organic EL element D1 is connected to low-voltage side power line 25. In this embodiment here, the voltage supplied to high-voltage side power line 24 is 20 volts, and the voltage supplied to low-voltage side power line 25 is 0 volt, for example.

As similar to the first exemplary embodiment, pixel circuit 30 comprises holding capacitor C1 for holding a voltage that determines an amount of the electric current supplied to driver transistor Q1, transistor Q2 for writing a voltage corresponding to an image signal into holding capacitor C1, and detection trigger capacitor C2 for detecting threshold voltage Vth of driver transistor Q1.

All of driver transistor Q1, transistors Q2 and Q4 that compose pixel circuit 30 shown here are N-channel thin film transistors. Although the driver transistor Q1 and transistors Q2 and Q4 are described here as being enhancement-type transistors, they may as well be depletion-type transistors.

Figure 7:
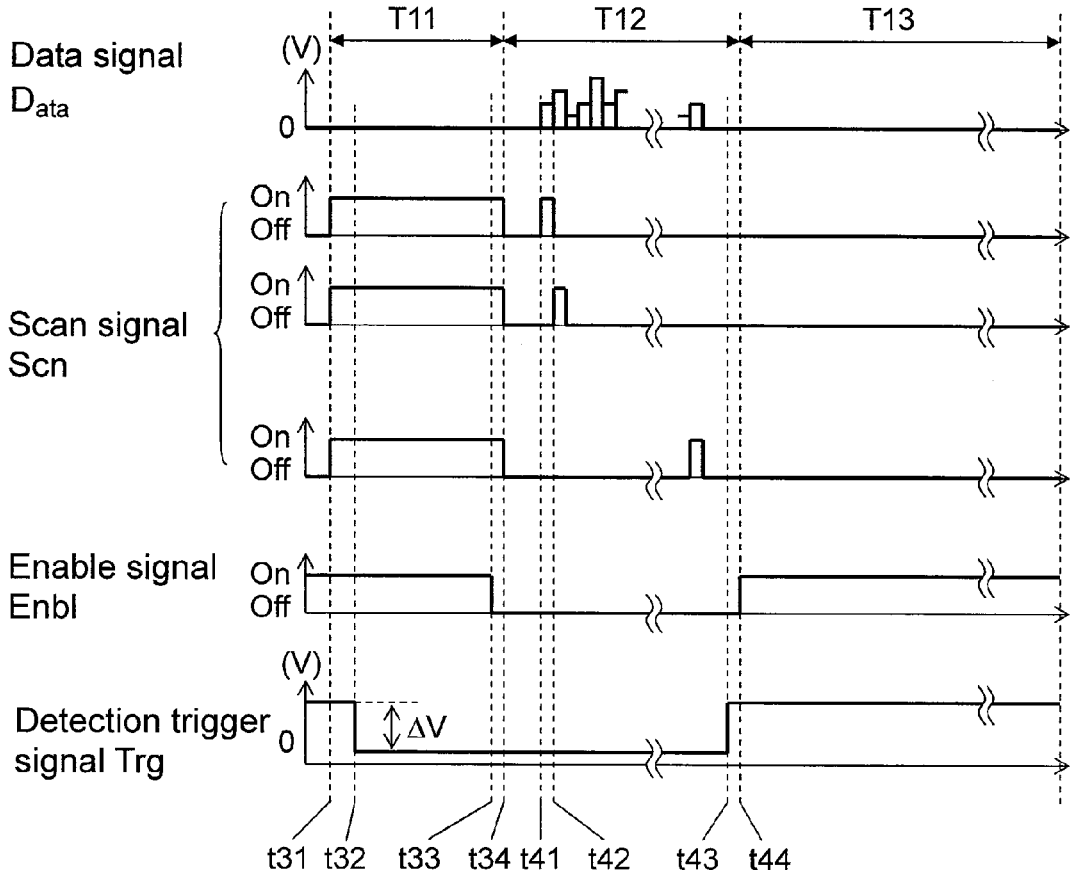
FIG. 7 is a timing chart showing operation of the pixel circuit according to the second exemplary embodiment of the present invention.

Description is provided next of how pixel circuit 30 operates in this exemplary embodiment. FIG. 7 is a timing chart showing the operation of pixel circuit 30 according to this exemplary embodiment of the invention.

In this exemplary embodiment, one field period is divided into three periods including threshold detecting period T11, writing period T12 and light-emitting period T13 for convenience' sake, and each of organic EL elements D1 is driven accordingly. In the threshold detecting period T11, threshold voltage Vth of driver transistor Q1 is detected. In the writing period T12, a voltage corresponding to the image signal is written into holding capacitor C1. In the light-emitting period T13, organic EL element D1 is driven to emit light according to the voltage written in holding capacitor C1. Description is provided hereinafter in further detail of how pixel circuit 30 operates in each of the above periods.

(Threshold Detecting Period T11)

Figure 8:
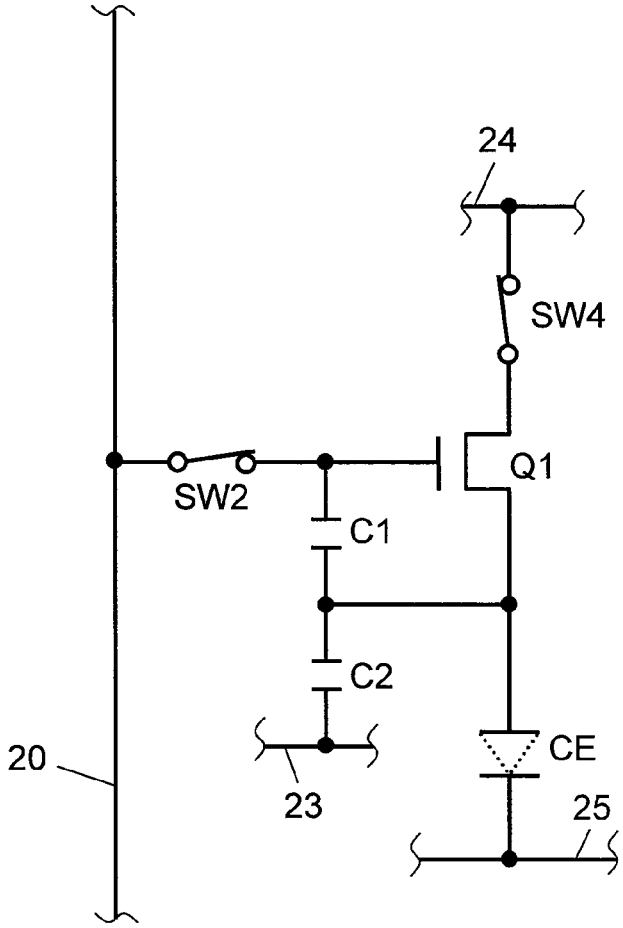
FIG. 8 is an explanatory diagram showing operation of the image display device during a threshold detecting period according to the second exemplary embodiment of the present invention.

FIG. 8 is an explanatory diagram showing operation of the image display device during the threshold detecting period T11 according to this exemplary embodiment. In FIG. 8, transistor Q2 of FIG. 6 is replaced by switch SW2, and transistor Q4 is replaced by switch SW4 for the purpose of easing the explanation. In addition, organic EL element D1 is replaced by capacitor CE.

At the initial time t31 of threshold detecting period T11, switch SW4 is in an on-state since enable signal Enbl is at a high level. Scan signal Scn rises to a high level at this time, and switch SW2 comes into an on-state so that data signal $D_{ata}$ of no potential, or 0 volt, is applied to the gate of driver transistor Q1. Driver transistor Q1 therefore turns to an off-state. There is thus no electric current to flow through organic EL element D1, and organic EL element D1 functions as capacitor CE. In addition, source voltage Vs of driver transistor Q1 becomes an off-state voltage VEoff of organic EL element D1.

Next, detection trigger signal Trg is decreased by voltage ΔV at time t32. This causes source voltage Vs of driver transistor Q1 to decrease by an amount obtained by capacitively dividing a value of voltage ΔV with a capacitance of detection trigger capacitor C2 and a combined capacitance of holding capacitor C1 and capacitor CE. The source voltage Vs thus becomes the same value as given by the equation 1 in the first exemplary embodiment.

As a result, driver transistor Q1 turns into an on-state since voltage Vgs between the gate and the source of driver transistor Q1 becomes equal to or greater than threshold voltage Vth. This causes holding capacitor C1 and capacitor CE to discharge their electric charges, and source voltage Vs starts rising due to electricity charged in detection trigger capacitor C2. When voltage Vgs between the gate and the source of driver transistor Q1 becomes equal to threshold voltage Vth, driver transistor Q1 turns into an off-state. Source voltage Vs of driver transistor Q1 thus becomes a value given by the equation 2, and voltage VC1 of holding capacitor C1 becomes equal to threshold voltage Vth. Accordingly, holding capacitor C1, detection trigger capacitor C2 and capacitor CE hold voltage Vth.

Even if driver transistor Q1 here is a transistor of depletion type, the threshold value of it can be detected in the manner as described in the first exemplary embodiment.

Following the above, enable signal Enbl is changed to a low level to turn switch SW4 into an off-state at the time t33 immediately before the end of threshold detecting period T11, and scan signal Scn is changed to a low level to turn switch SW2 into an off-state at the time t34.

(Writing Period T12)

Figure 9:
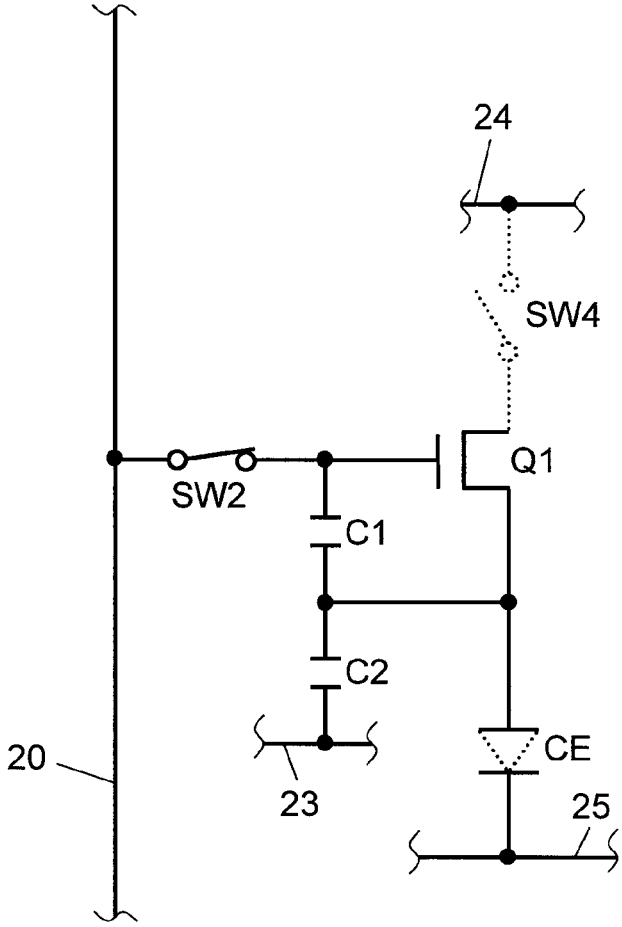
FIG. 9 is an explanatory diagram showing operation of the image display device during a writing period according to the second exemplary embodiment of the present invention.

FIG. 9 is an explanatory diagram showing operation of the image display device during the writing period T12 according to this exemplary embodiment of the invention.

At time t41 in writing period T12, scan signal Scn of the corresponding pixel circuit 30 is switched to a high level, and switch SW2 is turned into an on-state. FIG. 9 shows a state of pixel circuit 30 at time t41 on the premise that the pixel circuit 30 is located in the first row of the image display device. At this exact moment, voltage $V_{data}$ corresponding to the image signal supplied to data line 20 is applied to the gate of driver transistor Q1. This causes voltage VC1 of holding capacitor C1 to increase by an amount obtained by capacitively dividing a value of voltage $V_{data}$ with a capacitance of holding capacitor C1 and a combined capacitance of detection trigger capacitor C2 and capacitor CE, to become a value given by the equation 4.

When the writing operation in pixel circuit 30 is completed at time t42, the corresponding scan signal Scn is switched back to the low level to turn switch SW2 into the off-state. In addition, detection trigger signal Trg is switched back to the original voltage at time t43 immediately before the end of the writing period.

(Light-Emitting Period T13)

Figure 10:
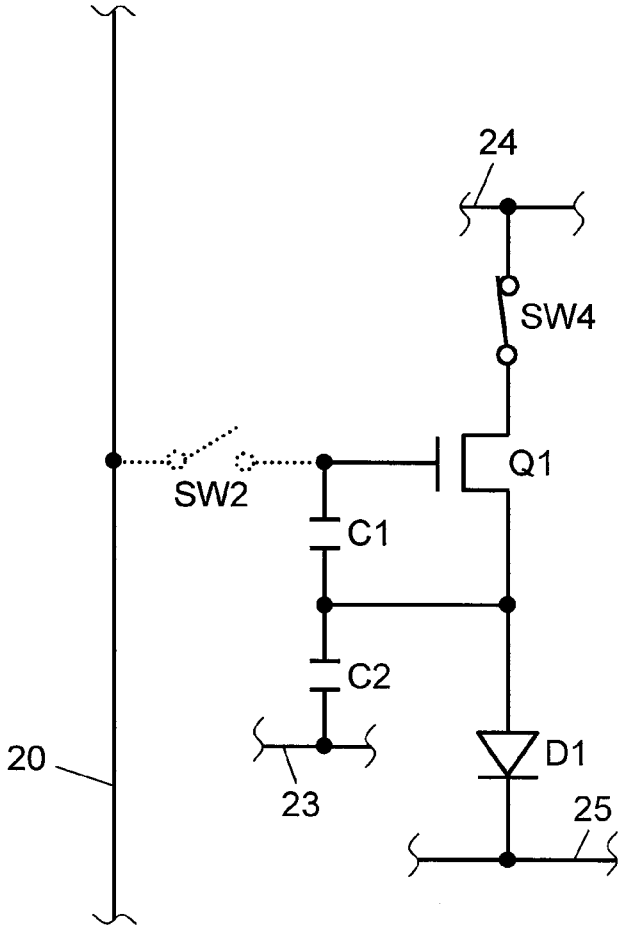
FIG. 10 is an explanatory diagram showing operation of the image display device during a light emitting period according to the second exemplary embodiment of the present invention.

FIG. 10 is an explanatory diagram showing operation of the image display device during the light-emitting period T13 according to this exemplary embodiment of the invention.

At the initial time t44 in the light-emitting period T13, enable signal Enbl is switched to a high level to turn switch SW4 into an on-state. Voltage VC1 of holding capacitor C1, i.e., voltage Vgs between the gate and the source of driver transistor Q1, is set to the voltage equal to or greater than the threshold voltage Vth during the writing period. Therefore, driver transistor Q1 lets an electric current corresponding to voltage $V_{data}$ to flow therethrough to have organic EL element D1 emit light of a brightness corresponding to the image signal. Electric current Ipxl that flows through organic EL element D1 during this period is given by the equation 5.

As discussed, the electric current Ipxl that flows through organic EL element D1 does not include the factor of threshold voltage Vth. The electric current Ipxl flowing through organic EL element D1 can thus make it emit light of the brightness corresponding to the image signal without being influenced by threshold voltage Vth of driver transistor Q1 even when it changes with lapse of time.

It is necessary that organic EL element D1 is driven in a manner not to cause unexpected changes in the voltage of holding capacitor C1 since the brightness of organic EL element D1 is determined by the voltage of holding capacitor C1. In this exemplary embodiment, the individual transistors are therefore controlled according to the sequence shown in FIG. 7 to suppress changes in the voltages of the individual points during the writing operation, so as to regulate positively the voltage of holding capacitor C1.

As described above, it is also possible to use only N-channel transistors according to the present exemplary embodiment to form pixel circuits 10, each having organic EL element D1 connected to the source of the respective driver transistor Q1 and the cathode of organic EL element D1 connected to the common low-voltage side power line. The pixel circuits in this exemplary embodiment are therefore very suitable for composing large-scale display devices with amorphous-silicon thin-film transistors. The structure is also preferable even when the pixel circuits are composed by using polysilicon thin film transistors.

Figure 11:
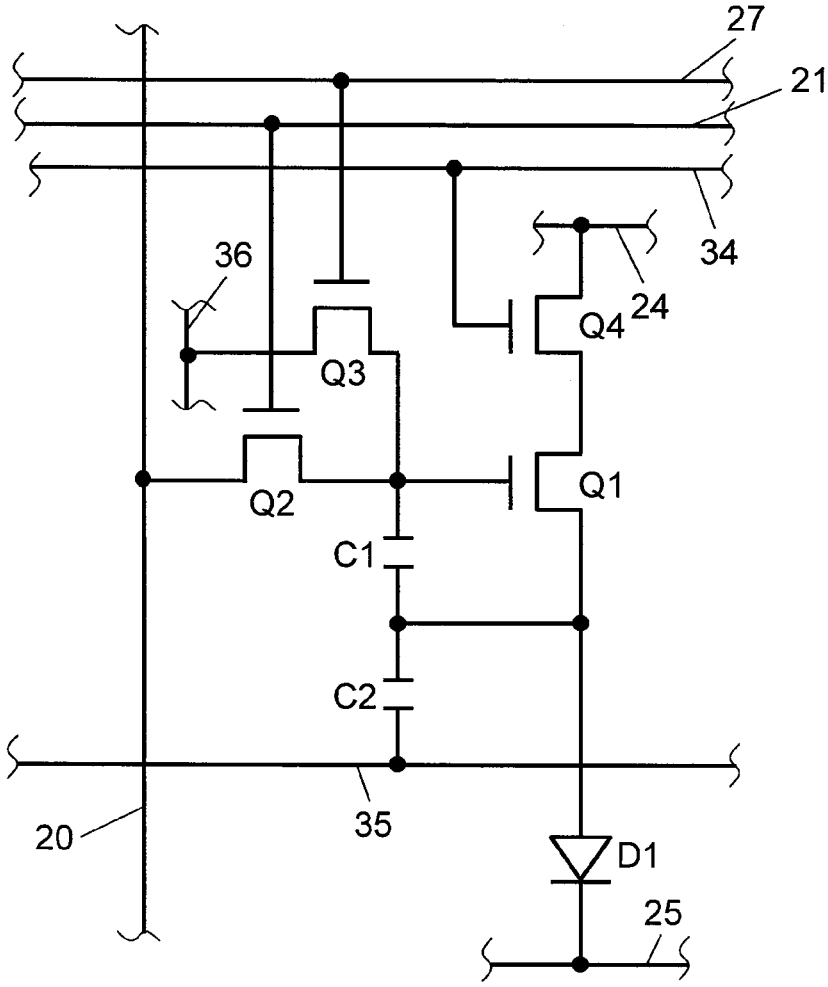
FIG. 11 is a circuit diagram showing a variation of the pixel circuit according to the second exemplary embodiment of the present invention.

In this exemplary embodiment the structure described above is an example in which one field period is divided into three periods including threshold detecting period T11, writing period T12 and light-emitting period T13, and all pixel circuits 30 are driven in a synchronized manner. However, the scope of the present invention is not considered to be limited by the embodiment described herein. FIG. 11 is a circuit diagram showing a variation of the pixel circuit according to this exemplary embodiment. The pixel circuit shown in FIG. 11 differs from the pixel circuit shown in FIG. 6 in the following aspects. That is, enable lines 34 are provided independently for the individual pixel circuits arranged to in the row direction, and detection trigger lines 35 are provided also independently for the individual pixel circuits arranged to in the row direction. Provided in addition are reference voltage lines 36 and transistors Q3, each serving as a switch for supplying a reference voltage to the gate of driver transistor Q1 when detecting threshold voltage Vth of driver transistor Q1. There are also control lines 27 for controlling transistors Q3 provided independently for the individual pixel circuits arranged in the row direction. The structure constructed above makes it possible to drive pixel circuits 30 in a manner to synchronize phases of the above three periods for those arranged along the row direction, and to shift the phases of the three periods for those arranged along the column direction so as to keep individual writing periods T12 from overlapping with one another. It hence becomes possible to prolong the duration of light-emitting periods T13 by virtue of the above technique of driving pixel circuits 30 while shifting their phases.

Third Exemplary Embodiment

Figure 12:
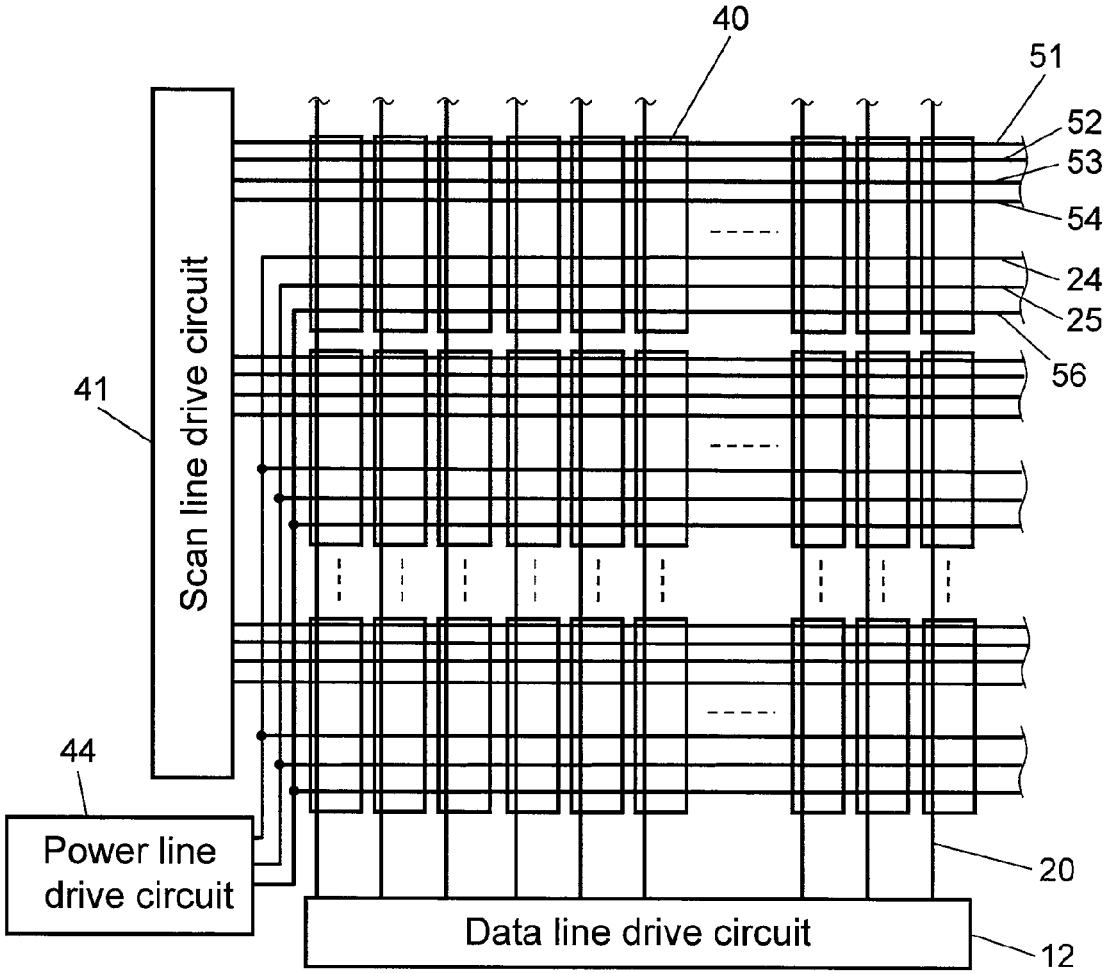
FIG. 12 is a schematic diagram showing a structure of an organic EL display according to a third exemplary embodiment of the present invention.

FIG. 12 is a schematic diagram showing a structure of an organic EL display device according to this exemplary embodiment of the invention.

The organic EL display device in this exemplary embodiment comprises a plurality of pixel circuits 40 arranged in a matrix form, scan line drive circuit 41, data line drive circuit 42 and power line drive circuit 44. Scan line drive circuit 41 supplies scan signal Scn, reset signal Rst, merge signal Mrg and detection trigger signal Trg to each of pixel circuits 40. Data line drive circuit 42 supplies data signal $D_{ata}$ corresponding to an image signal to each of pixel circuits 40. Power line drive circuit 44 supplies an electric power to pixel circuits 40. Description is provided in this exemplary embodiment also of an example that pixel circuits 10 are arranged in a form of n-row by m-column matrix.

Scan line drive circuit 41 supplies scan signal Scn independently to each of scan lines 51 connecting across pixel circuits 40 arranged in the row direction in FIG. 12, and reset signal Rst independently to each of reset lines 52 connecting across pixel circuits 40 arranged in the row direction. Scan line drive circuit 41 also supplies merge signal Mrg independently to each of merge lines 53 connecting across pixel circuits 40 arranged in the row direction, and detection trigger signal Trg independently to each of detection trigger lines 54 connecting across pixel circuits 40 arranged in the row direction. On the other hand, data line drive circuit 12 supplies data signal $D_{ata}$ independently to each of data lines 20 connecting across pixel circuits 40 arranged in the column direction in FIG. 12. In this exemplary embodiment, a number of scan lines 51, reset lines 52, merge lines 53 or detection trigger lines 54, and a number of data lines 20 are n and m respectively.

Power line drive circuit 44 supplies an electric power between high-voltage side power lines 24 and low-voltage side power lines 25 connecting throughout all pixel circuits 40. Power line drive circuit 44 also supplies a reference voltage to reference voltage lines 56 connecting throughout all pixel circuits 40. In this exemplary embodiment, although the reference voltage of 0-volt potential is shown as an example for simplicity of the explanation, this shall not be taken as restrictive in the scope of this invention.

Figure 13:
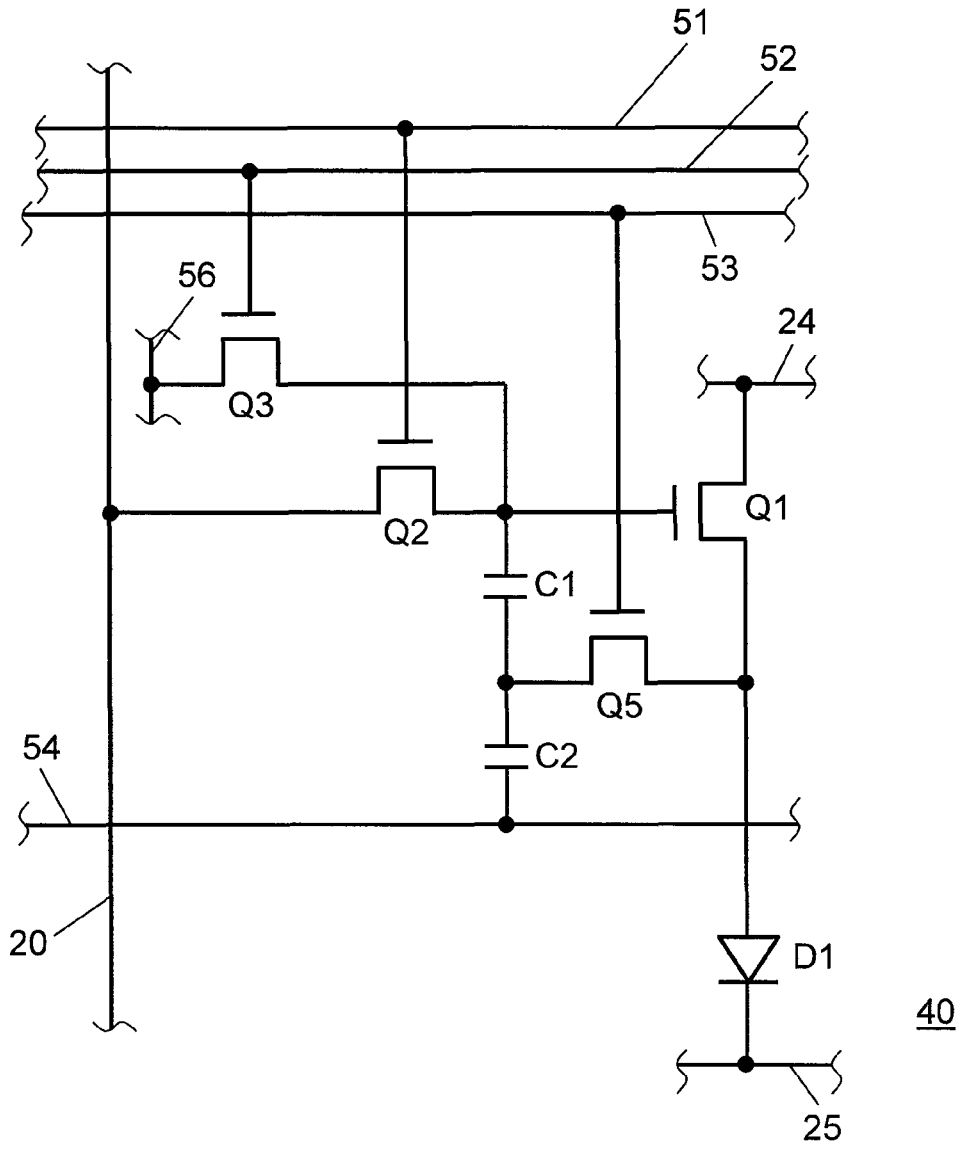
FIG. 13 is a diagram of a pixel circuit according to the third exemplary embodiment of the present invention.

FIG. 13 is a circuit diagram of pixel circuit 40 according to this exemplary embodiment of the invention. In FIG. 13, like reference marks are used to designate like components as those of the first exemplary embodiment and their detailed description will be omitted.

Pixel circuit 40 according to this exemplary embodiment comprises transistors Q3 and Q5 in addition to organic EL element D1, driver transistor Q1, holding capacitor C1 and transistor Q2 functioning as a writing switch. Transistor Q3 serves as a reference switch for providing the reference voltage to the gate of driver transistor Q1 when detecting threshold voltage Vth of driver transistor Q1. Transistor Q5 serves as a separation switch for separating holding capacitor C1 from the source of driver transistor Q1 during the writing period when the voltage is written into holding capacitor C1. Pixel circuit 40 further comprises detection trigger line 54 and detection trigger capacitor C2 for supplying a voltage for decreasing source voltage Vs of driver transistor Q1 for the purpose of detecting threshold voltage Vth of driver transistor Q1. All of driver transistor Q1 and transistors Q2, Q3 and Q5 that compose pixel circuit 40 shown here are N-channel thin film transistors. Although the driver transistor Q1 and transistors Q2, Q3 and Q5 are described as being enhancement-type transistors, they may as well be depletion-type transistors for this exemplary embodiment.

Pixel circuit 40 in this exemplary embodiment has organic EL element D1 connected between the source of driver transistor Q1 and low-voltage side power line 25, and the drain of driver transistor Q1 connected to high-voltage side power line 24. In other words, the drain of driver transistor Q1 is connected to high-voltage side power line 24 and the source of driver transistor Q1 is connected to the anode of organic EL element D1. The cathode of organic EL element D1 is connected to low-voltage side power line 25. In this embodiment here, the voltage supplied to high-voltage side power line 24 is 20 volts, and the voltage supplied to low-voltage side power line 25 is 0 volt, for example.

One terminal of detection trigger capacitor C2 is connected to the source of driver transistor Q1 through transistor Q5, or the separation switch, and the other terminal of detection trigger capacitor C2 is connected to detection trigger line 54 that supplies a voltage for changing the source voltage of driver transistor Q1. One terminal of holding capacitor C1 is connected to the gate of driver transistor Q1, and the other terminal of holding capacitor C1 is connected to detection trigger line 54 through detection trigger capacitor C2.

The gate of driver transistor Q1 is connected to data line 20 through transistor Q2. The gate of driver transistor Q1 is also in connection with either the drain or the source of transistor Q3 serving as the reference switch. The other of the source or the drain of transistor Q3 is connected to reference voltage line 56, which supplies the reference voltage. The gate of transistor Q2 is connected to scan line 51, the gate of transistor Q3 is connected to reset line 52, and the gate of transistor Q5 is connected to merge line 53.

Figure 14:
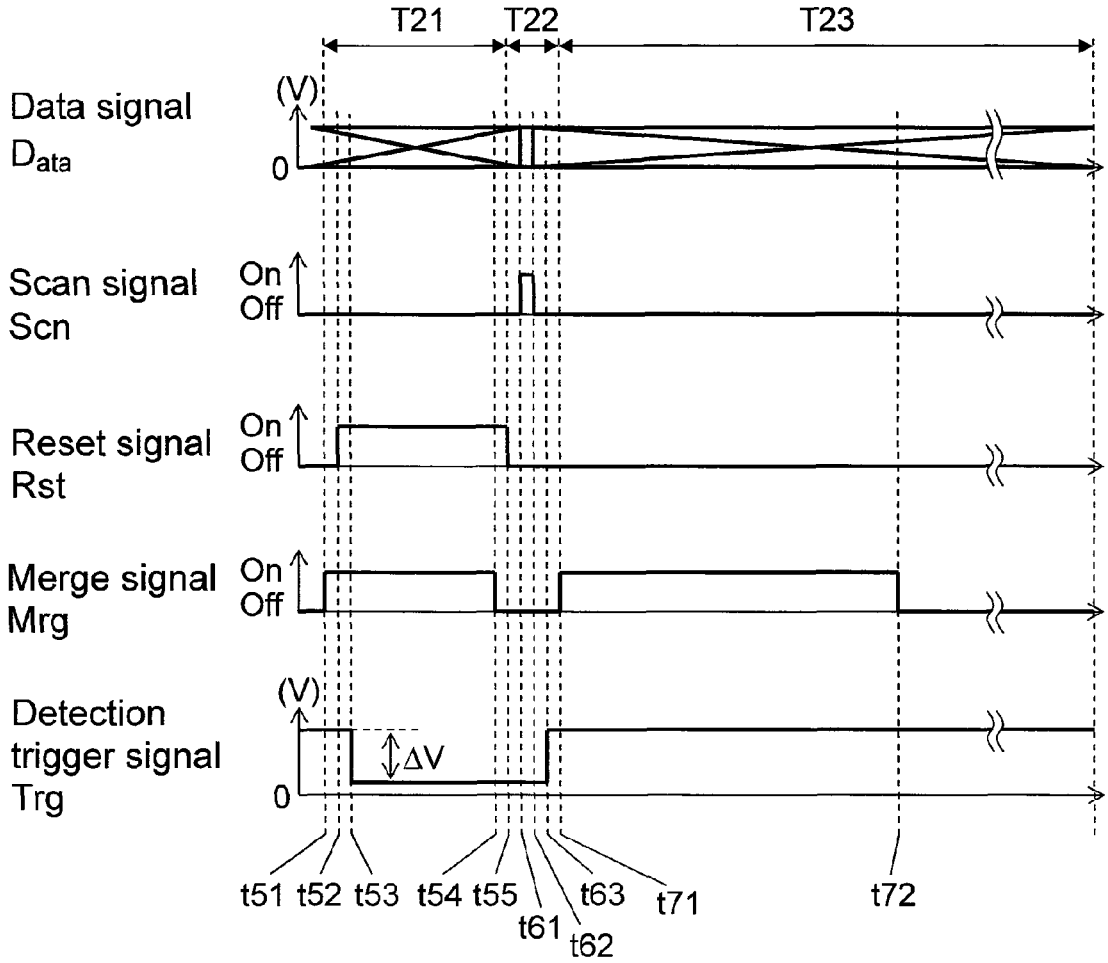
FIG. 14 is a timing chart showing operation of the pixel circuit according to the third exemplary embodiment of the present invention.

Description is provided next of how pixel circuit 40 operates in this exemplary embodiment. FIG. 14 is a timing chart showing the operation of pixel circuit 40 according to this exemplary embodiment of the invention.

In this exemplary embodiment, each of pixel circuits 40 performs an operation of detecting threshold voltage Vth of driver transistor Q1, an operation of writing data signal $D_{ata}$ corresponding to the image signal into holding capacitor C1, and an operation of driving organic EL element D1 to emit light according to the voltage written in holding capacitor C1 during a period of one field. A period for detecting threshold voltage Vth, another period for writing data signal $D_{ata}$, and still another period for driving organic EL element D1 to emit light are designated as threshold detecting period T21, writing period T22 and light-emitting period T23 respectively in the following description, which provides details of the operations. Threshold detecting period T21, writing period T22 and light-emitting period T23 are defined for each individual pixel circuit 40 and phases of these three periods need not be synchronized for all pixel circuits 40. In this exemplary embodiment, pixel circuits 40 are driven in a manner to synchronize the phases of the above three periods for those arranged along the row direction, and to shift the phases of the three periods for those arranged along the column direction so as to keep individual writing periods T22 from overlapping with one another. It is desirable to use the above technique of driving pixel circuits 40 while shifting their phases in the light of improving the brightness of the image display device since it can prolong the duration of light-emitting periods T23.

(Threshold Detecting Period T21)

Figure 15:
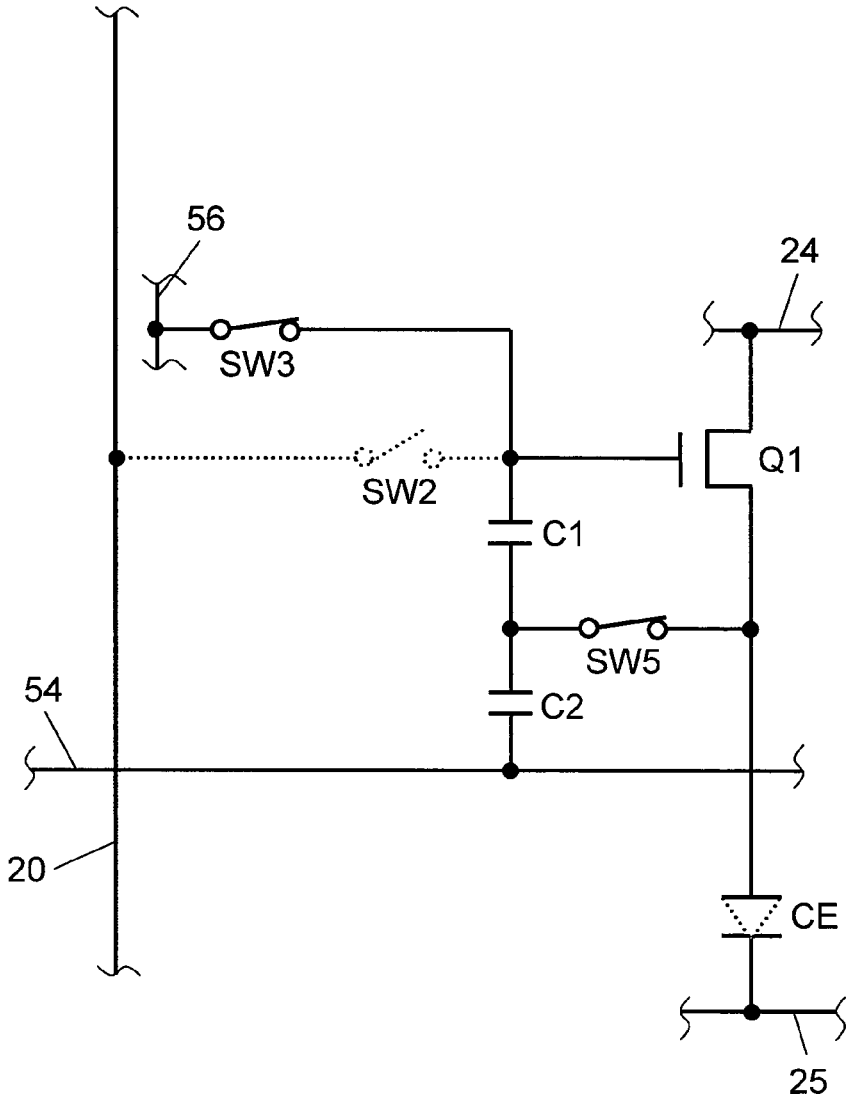
FIG. 15 is an explanatory diagram showing operation of the image display device during a threshold detecting period according to the third exemplary embodiment of the present invention.

FIG. 15 is an explanatory diagram showing operation of the image display device during the threshold detecting period T21 according to this exemplary embodiment. In FIG. 15, transistor Q2 of FIG. 13 is replaced by switch SW2, transistor Q3 by switch SW3 and transistor Q5 by switch SW5 for ease of the explanation. In addition, organic EL element D1 is replaced by capacitor CE.

At the initial time t51 of threshold detecting period T21, merge signal Mrg is switched to a high level to turn switch SW5 into an on-state, and reset signal Rst is switched to a high level at time t52 to also turn switch SW3 into an on-state. This impresses the reference voltage of 0-volt potential on the gate of driver transistor Q1, which turns driver transistor Q1 into an off-state. There is thus no electric current to flow through organic EL element D1, and organic EL element D1 functions as capacitor CE. In addition, source voltage Vs of driver transistor Q1 becomes an off-state voltage VEoff of organic EL element D1. Next, detection trigger signal Trg is decreased by voltage AV at time t53. This causes source voltage Vs of driver transistor Q1 to decrease by an amount obtained by capacitively dividing a value of voltage ΔV with a capacitance of detection trigger capacitor C2 and a combined capacitance of holding capacitor C1 and capacitor CE. The source voltage Vs thus becomes the same value as given by the equation 1 in the first exemplary embodiment.

As a result, driver transistor Q1 turns into an on-state since voltage Vgs between the gate and the source of driver transistor Q1 becomes equal to or greater than threshold voltage Vth. This causes holding capacitor C1 and capacitor CE to discharge their electric charges, and source voltage Vs starts rising due to electricity charged in detection trigger capacitor C2. When voltage Vgs between the gate and the source of driver transistor Q1 becomes equal to threshold voltage Vth, driver transistor Q1 turns into an off-state. Source voltage Vs of driver transistor Q1 thus becomes a value given by the equation 2, and voltage VC1 of holding capacitor C1 becomes equal to threshold voltage Vth. Accordingly, holding capacitor C1, detection trigger capacitor C2 and capacitor CE hold voltage Vth.

Even if driver transistor Q1 here is a transistor of depletion type, the threshold value of it can be detected in the same manner as described in the first exemplary embodiment.

Following the above, merge signal Mrg is changed to a low level to turn switch SW5 into an off-state at the time t54, and reset signal Rst is changed to a low level to turn switch SW3 into an off-state at the time t55.

(Writing Period T22)

Figure 16:
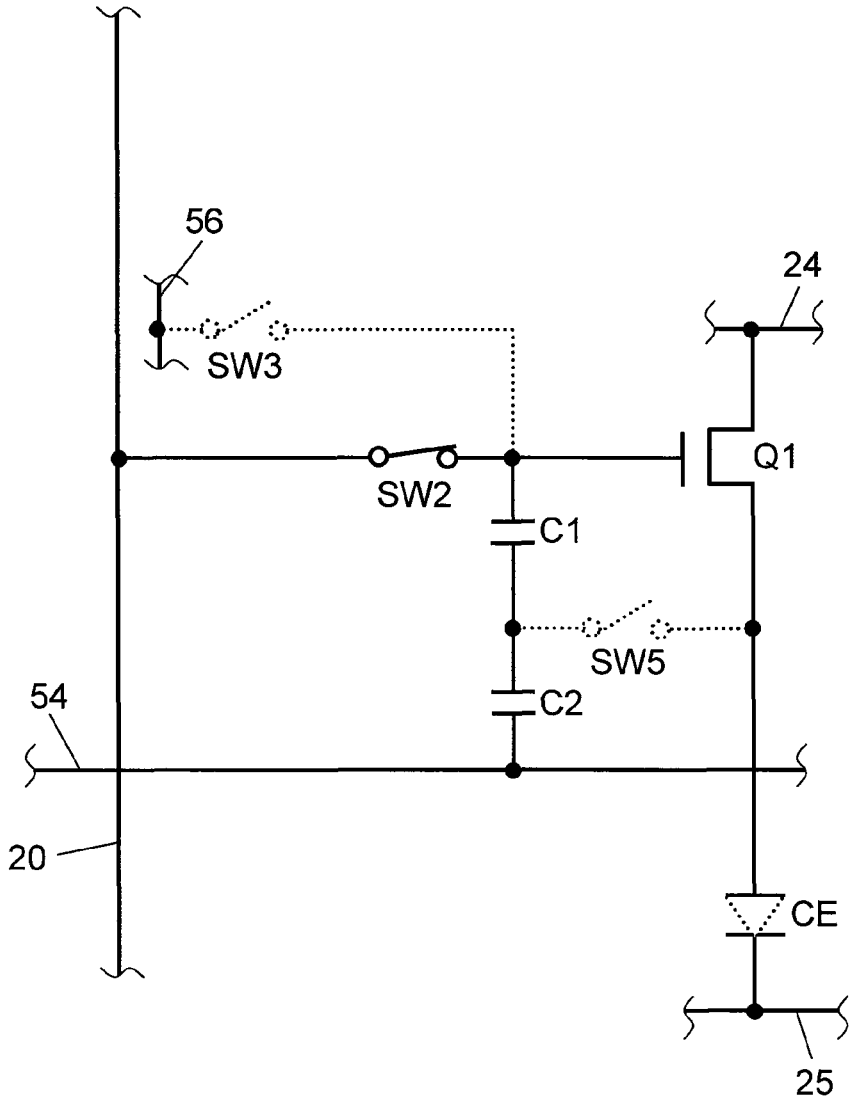
FIG. 16 is an explanatory diagram showing operation of the image display device during a writing period according to the third exemplary embodiment of the present invention.

FIG. 16 is an explanatory diagram showing operation of the image display device during the writing period T22 according to this exemplary embodiment of the invention.

At time t61 in writing period T22, scan signal Scn is switched to a high level, and switch SW2 is turned into an on-state. At this exact moment, voltage $V_{data}$ corresponding to the image signal supplied to data line 20 is applied to the gate of driver transistor Q1. This causes voltage VC1 of holding capacitor C1 to increase by an amount obtained by capacitively dividing a value of voltage $V_{data}$ with a capacitance of holding capacitor C1 and a capacitance of detection trigger capacitor C2, to become a value given by $$VC1 = Vth + \frac{C2}{C1 + C2} \cdot Vdata. \quad \text{(Equation 7)}$$

When the writing operation in pixel circuit 40 is completed at time t62, scan signal Scn is switched back to the low level to turn switch SW2 into the off-state. Following the above, detection trigger signal Trg is switched back to the original voltage at time t63.

(Light-Emitting Period T23)

Figure 17:
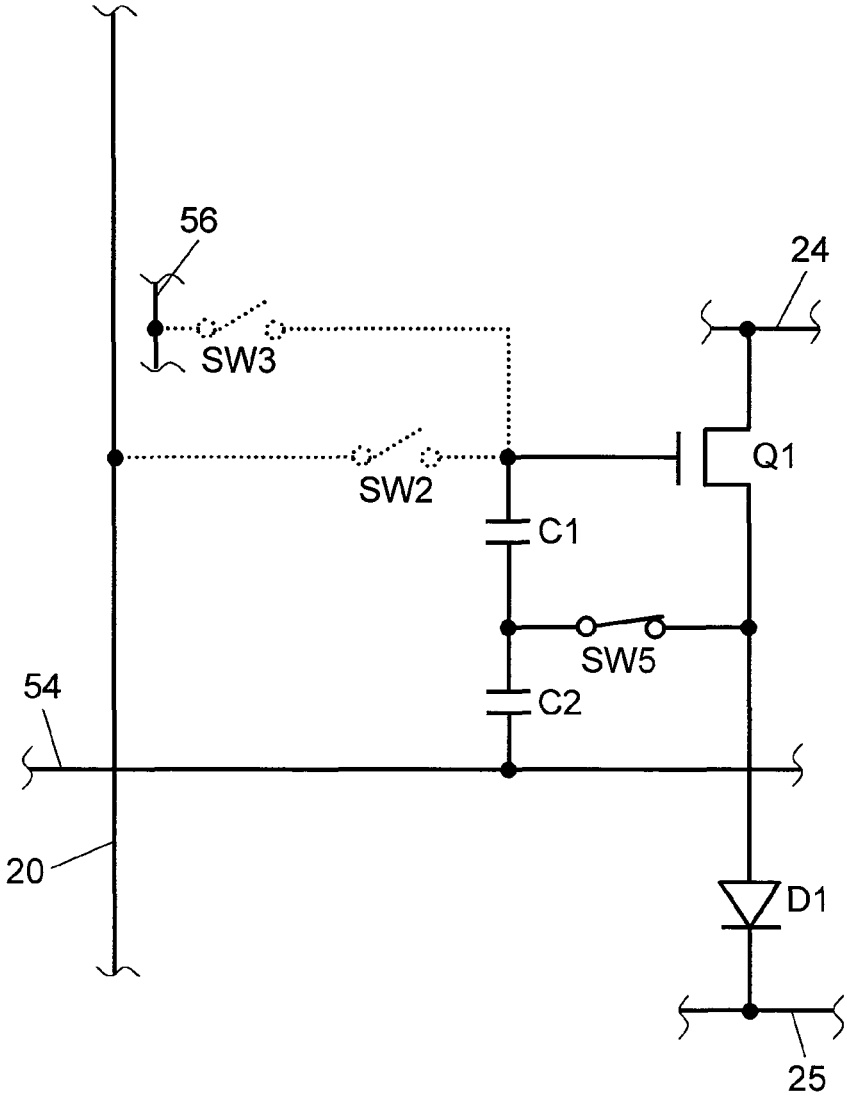
FIG. 17 is an explanatory diagram showing operation of the image display device during a light emitting period according to the third exemplary embodiment of the present invention.

FIG. 17 is an explanatory diagram showing operation of the image display device during the light-emitting period T23 according to this exemplary embodiment of the invention.

Merge signal Mrg is switched to a high level at time t71 to turn switch SW5 into an on-state. This causes voltage VC1 of holding capacitor C1 to become a value equal to voltage Vgs between the gate and the source of driver transistor Q1. Since voltage VC1 is set to a value equal to or greater than the threshold voltage Vth during the writing period, driver transistor Q1 allows an electric current of an amount proportional to voltage $V_{data}$ corresponding to the image signal to flow therethrough to have organic EL element D1 emit light of a brightness corresponding to the image signal. An electric current Ipxl that flows through organic EL element D1 during this period is given by $$Ipxl = \frac{\beta}{2} \cdot (Vgs - Vth)^2 = \frac{\beta}{2} \cdot \left(\frac{C2}{C1 + C2} \cdot Vdata\right)^2, \quad \text{(Equation 8)}$$

which indicates that it is not influenced by threshold voltage Vth. Character β in the above equation is a coefficient determined by the equation 6.

During light-emitting period T23, the threshold voltage of transistor Q5 varies when switch SW5, i.e., transistor Q5, is kept in the on-state, and causes degradation of an on-state characteristic. It is therefore preferable that merge signal Mrg is switched to a low level to turn switch SW5 into the off-state at time t72 when holding capacitor C1 and detection trigger capacitor C2 are charged sufficiently at their connecting node with a source potential of driver transistor Q1. This does not affect to the luminance of organic EL element D1 since the voltages of the individual components remain unchanged even when switch SW5 is turned into the off-state.

According to this exemplary embodiment as discussed, the electric current Ipxl that flows through organic EL element D1 does not include a factor of threshold voltage Vth. The electric current Ipxl flowing through organic EL element D1 can thus make it emit light of the brightness corresponding to the image signal without being influenced by threshold voltage Vth of driver transistor Q1 even when it changes with lapse of time.

Since the pixel circuit of this exemplary embodiment has no element in series connection with organic EL element D1, other than driver transistor Q1, it can reduce a loss of the power, thereby providing the image display device of high efficiency.

It is necessary that organic EL element D1 is driven in a manner not to cause unexpected changes in the voltage of holding capacitor C1 since the brightness of organic EL element D1 is determined by the voltage of holding capacitor C1. For this reason, the individual transistors are controlled according to the sequence shown in FIG. 14 to positively regulate the voltage of holding capacitor C1.

As described above, the present exemplary embodiment also makes it feasible to use only N-channel transistors to form pixel circuits 40, each having organic EL element D1 connected to the source of driver transistor Q1 and cathode of organic EL element D1 connected to the common low-voltage side power line. The pixel circuits in this exemplary embodiment are therefore very suitable for composing large-scale display devices with amorphous-silicon thin-film transistors. The structure is also preferable even when pixel circuits are composed by using polysilicon thin film transistors.

Figure 18:
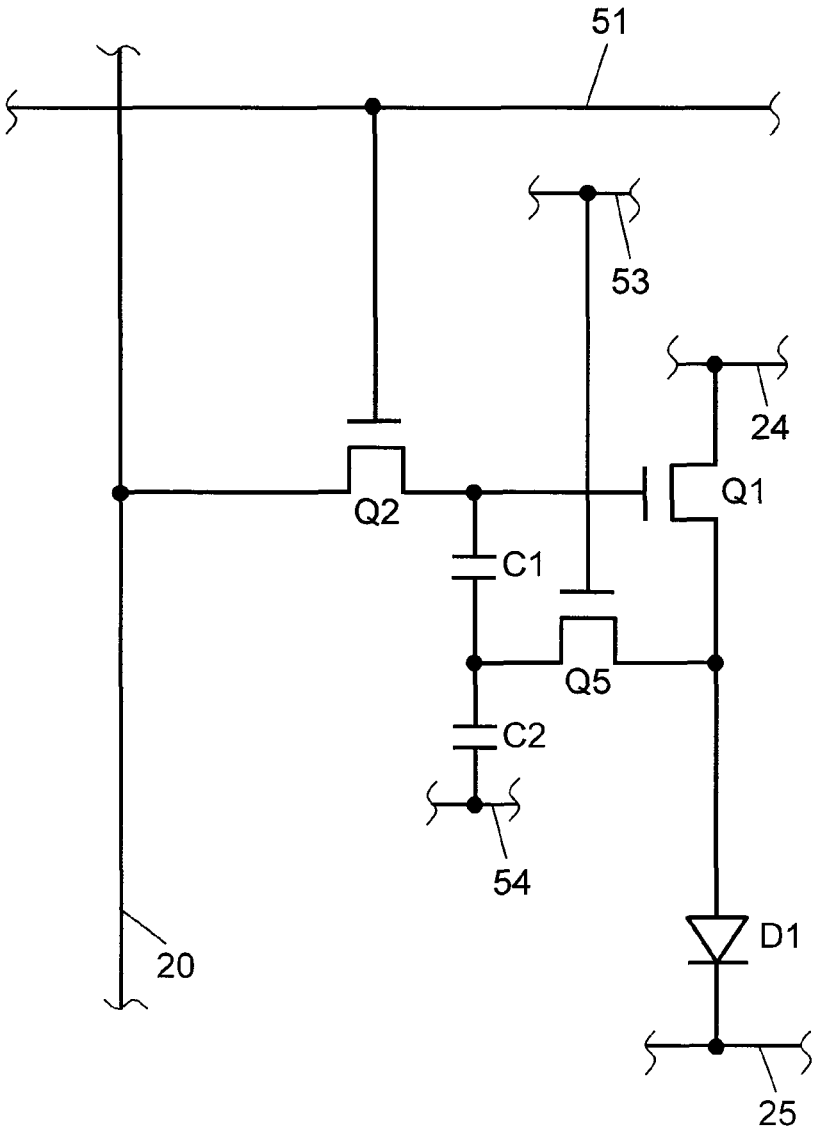
FIG. 18 is a circuit diagram showing a variation of the pixel circuit according to the third exemplary embodiment of the present invention.

In this exemplary embodiment, what has been described is the structure, in which pixel circuits 40 are driven in a manner to synchronize the phases of the three periods, namely threshold detecting period T21, writing period T22, and light-emitting period T23, for those arranged along the row direction, and to shift the phases of the three periods for those arranged along the column direction so as to keep the individual writing periods T22 from overlapping with one another. It becomes possible to prolong the duration of light-emitting periods T23 by driving pixel circuits 40 while shifting their phases. However, this shall not be taken as restrictive in the scope of this invention. FIG. 18 is a circuit diagram showing a variation of the pixel circuit according to the third exemplary embodiment of the present invention. In the case of pixel circuits shown in FIG. 18, a period of one field is divided into three periods including threshold detecting period T21, writing period T22 and light-emitting period T23, and all pixel circuits 40 are driven in a synchronized manner.

The pixel circuit shown in FIG. 18 differs from the pixel circuit of FIG. 13 in the following aspects. That is, detection trigger lines 54 are used commonly for all pixel circuits, and so are merge lines 53. In addition, the voltage of data lines 20 is used as the reference voltage for detecting threshold voltage Vth of driver transistor Q1, and transistor Q3 functioning as the reference switch and the reference voltage line for supplying the reference voltage to the gate of driver transistor Q1 are eliminated. This structure is advantageous for producing high-definition type image display devices since it simplifies the configuration of the pixel circuits.

It shall be noted that all figures and numbers of the voltages and other values specified in any of the above described exemplary embodiments are just examples, and that it is preferable to determine them as appropriate according to characteristics of the individual organic EL elements and specifications of the applicable image display devices, and the like.

INDUSTRIAL APPLICABILITY

According to the present invention, it becomes possible to use only N-channel transistors to form pixel circuits comprised of current-driven type light-emitting elements connected with the sources of driver transistors, and these pixel circuits are therefore useful for image display devices of the active matrix type that use current-driven type light-emitting elements.

The invention claimed is:

1. An image display device having a plurality of pixel circuits arranged in a matrix form, each of the pixel circuits comprising:

a current-driven type light-emitting element;

a driver transistor for supplying an electric current to the current-driven type light-emitting element;

a holding capacitor for holding a voltage that determines an amount of the electric current supplied from the driver transistor; and a writing switch for writing a voltage corresponding to an image signal into the holding capacitor, wherein the driver transistor formed in each of the pixel circuits is an N-channel transistor, each of the pixel circuits further comprises a detection trigger line and a detection trigger capacitor for supplying a voltage to change a source voltage of the driver transistor, and one terminal of the detection trigger capacitor is connected to a source of the driver transistor and the other terminal of the detection trigger capacitor is connected to the detection trigger line, wherein when an amount of voltage on the detection trigger line is changed, an amount of a voltage change on a connection node between the detection trigger capacitor and the holding capacitor is equal or less than a value of C2/(C1+C2) multiplied by the amount of the voltage change on the detection trigger line, where C1 is a capacitance of the holding capacitor and C2 is a capacitance of the detection trigger capacitor, and wherein the connection node between the detection trigger capacitor and the holding capacitor is connected to a source of the driver transistor exclusive of a connection to a gate of the driver transistor.

2. The image display device of claim 1, wherein in each of the pixel circuits, the current-driven type light-emitting element is connected between the source of the driver transistor and a low-voltage side power line, and each of the pixel circuits further comprises an enable switch connected between a drain of the driver transistor and a high-voltage side power line.

3. The image display device of claim 1, wherein each of the pixel circuits further comprises a separation switch connected to the detection trigger capacitor so that the one terminal of the detection trigger capacitor is connected to the source of the driver transistor through the separation switch.

4. The image display device of claim 3, wherein in each of the pixel circuits, the current-driven type light-emitting element is connected between the source of the driver transistor and the low-voltage side power line, and a drain of the driver transistor is connected to the high-voltage side power line.

5. The image display device of claim 3, wherein each of the pixel circuits further comprises a reference switch, one terminal of the reference switch is connected to a gate of the driver transistor, and the other terminal of the reference switch is connected to a reference voltage line for applying a reference voltage.

6. The image display device of claim 4, wherein each of the pixel circuits further comprises a reference switch, one terminal of the reference switch is connected to a gate of the driver transistor, and the other terminal of the reference switch is connected to a reference voltage line for applying a reference voltage.

* * * * *